US005239732A

United States Patent [19]

Steven

[11] Patent Number: 5,239,732

[45] Date of Patent: Aug. 31, 1993

[54] ADJUSTABLE NON-TYING RESILIENT SECURING APPARATUS FOR SHOES

[76] Inventor: Zack Steven, 2334 Como Ave., St. Paul, Minn. 55108

[21] Appl. No.: 919,890

[22] Filed: Jul. 27, 1992

[51] Int. Cl.[5] ..... A43C 1/02

[52] U.S. Cl. ..... 24/573.1; 24/713

[58] Field of Search ..... 24/712, 713, 713.1, 24/573.1, 573.7, 300, 301, 712.1; 36/50.1

[56] References Cited

U.S. PATENT DOCUMENTS

| | | | |
|---|---|---|---|
| 562,114 | 6/1896 | Benford . | |
| 607,813 | 7/1898 | Whyman | 24/713 |
| 794,128 | 7/1905 | Smith et al. . | |
| 1,740,506 | 12/1929 | Grosser | 24/713 |
| 1,772,238 | 8/1930 | Bonne | 24/573.1 |
| 1,778,954 | 10/1930 | Mislin | 24/713 |
| 1,966,135 | 7/1934 | Reh . | |
| 2,049,932 | 8/1936 | Voit et al. | 24/713 |
| 2,270,702 | 1/1942 | Getmansky | 24/301 X |
| 2,289,225 | 7/1942 | Tonai . | |
| 2,580,843 | 1/1952 | Sam | 24/573.1 |
| 3,636,594 | 1/1972 | Faivre | 24/713.1 X |
| 3,701,572 | 10/1972 | Velasquez . | |
| 4,144,621 | 3/1979 | Green . | |
| 4,210,983 | 7/1980 | Green . | |
| 4,296,515 | 10/1981 | Hauser | 24/713 X |

FOREIGN PATENT DOCUMENTS

| | | | |
|---|---|---|---|
| 156995 | 9/1939 | Fed. Rep. of Germany | 24/713 |

*Primary Examiner*—James R. Brittain

*Attorney, Agent, or Firm*—Merchant, Gould, Smith, Edell, Welter & Schmidt

[57] ABSTRACT

A securing apparatus for extending between a pair of generally opposing eyelets on a shoe, and a method of use thereof. The resilient member has a fixed gripping member attached to one end and an adjustable gripping apparatus engaged at some point along its length. The fixed gripping member has a terminal end which is permanently attached to the resilient member and a free end. The adjustable gripping mechanism is releasably engaged with the resilient member along the length thereof, whereby adjusting the position of the adjustable gripping mechanism relative to the fixed gripping member alters the operative length of the adjustable securing apparatus.

5 Claims, 1 Drawing Sheet

ADJUSTABLE NON-TYING RESILIENT SECURING APPARATUS FOR SHOES

BACKGROUND OF THE INVENTION

1. Field of the Invention

This invention relates in general to a resilient securing apparatus for shoes, and in particular, to an adjustable securing apparatus wherein the gripping members of the apparatus are concealed while spanning a single pair of eyelets to replace standard shoelaces.

2. Description of the Prior Art

The prior art discloses various resilient securing mechanisms for use between the eyelets of a pair of shoes.

U.S. Pat. No. 562,114 discloses a non-adjustable shoe fastening device comprising two pre-bent hooks connected by a resilient loop. The pre-bent hooks are not concealed when attached to a shoe.

U.S. Pat. No. 794,128 discloses a non-adjustable single elastic lace with cylindrical metal catches on both ends.

U.S. Pat. No. 1,966,135 discloses a non-adjustable resilient cord with a looping attachment mechanism on both ends. The attachment mechanisms are not concealed by the shoe when in use.

U.S. Pat. No. 2,289,225 discloses a non-adjustable elastic lace with a hook on each end that catches in the eyelet.

U.S. Pat. No. 3,701,572 discloses a stretch shoelace with a single loop on one end and a hook on the other.

U.S. Pat. No. 4,144,983 discloses an elongated elastic lace with a thin metal secured to each end thereof, which may be bent at fixed intervals so as to be adjustable to fit between the eyelets of various sized shoes.

U.S. Pat. No. 4,210,983 discloses a non-adjustable resilient gripping mechanism for the eyelets of shoes with a pair of identical gripping mechanisms, one permanently affixed to each end thereof.

SUMMARY OF THE INVENTION

The principle object of the present invention is to provide an adjustable securing apparatus for shoes which facilitates putting-on and removal of the shoes, and a method of use thereof.

The adjustable securing apparatus extends between a pair of generally opposing eyelets on a shoe. A resilient member having a fixed gripping member is attached to one end and an adjustable gripping apparatus is attached to the other end. The fixed gripping member has a terminal end which is permanently attached to the resilient member and a free end. The adjustable gripping mechanism is releasably engaged with the resilient member along the length thereof, whereby adjusting the position of the adjustable gripping mechanism relative to the fixed gripping member alters the operative length of the adjustable securing apparatus.

The adjustable securing apparatus of the present invention preserves the look of standard shoelaces, wherein the gripping members are entirely concealed by the shoe. The adjustable securing apparatus also provides an improved resilient securing mechanism which is easy to use, so as to permit use by people of all ages and those with disabilities. Further, the adjustable securing apparatus provides an alternative to standard laces which can be manufactured in colors and decorated with beads and designs.

The method of using the adjustable securing apparatus includes adjusting the position of the adjustable gripping mechanism along the resilient member, inserting the fixed gripping member through the bottom portion of an eyelet so that the adjustable gripping member engages the bottom portion of the eyelet, and inserting the fixed gripping member through the top portion of a generally opposing second eyelet so that the terminal end and free end of the fixed gripping member engage with the bottom portion of the second eyelet.

BRIEF DESCRIPTION OF THE DRAWINGS

The description of the present invention may be more readily understood when accompanied by reference to the following drawings.

DETAILED DESCRIPTION OF THE DRAWINGS

The present invention relates to an adjustable securing apparatus 12 for shoes 10 which may be easily adjusted and re-adjusted, while at the same time preserving the look of standard shoelaces. As will be discussed below, the gripping members 15, 16 are entirely concealed by the shoe when in use.

The present invention converts ordinary laced shoes into "slip-on" shoes, which do not require tying. It should be noted that precise adjustability is an important feature of the adjustable securing member 15 (See FIG. 2), because the required distance between the eyelets can differ greatly, even on a single shoe.

Figure 1:
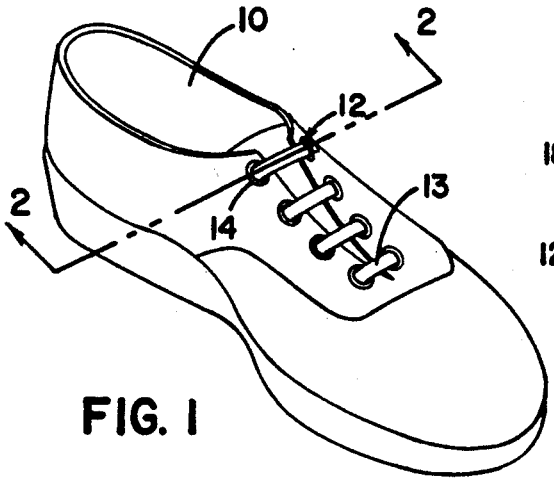
FIG. 1 is a perspective view of a shoe with the preferred adjustable securing apparatus extending between pairs of corresponding eyelets.

The preferred adjustable securing apparatus 12 illustrated in FIG. 1 can be used in any shoe that has eyelets, such as standard shoe 10. The shoe 10 is equipped with pairs of opposing eyelets 14, 14'. The preferred adjustable securing apparatus 12 described herein may extend between the corresponding eyelets 14, 14' of the shoe 10. It will also be understood that the preferred adjustable securing apparatus 12 may extend between any pair of eyelets 14 on the shoe 10. For example, the adjustable securing apparatus 12 may be attach to diagonally oriented eyelets.

The resilient member 13 is preferably composed of a suitable elastic material with sufficient elasticity to allow the user's foot to enter the shoe 10, yet with sufficient resilience to secure the user's foot snugly in the shoe 10. While the resilient member 13 is preferably a thin ribbon-shaped material, it will be understood by those skilled in the art that the resilient member 13 may be of a variety of shapes depending on need for durability, style, or to accommodate a particular type of shoe. For example, the resilient member 13 may be circular to simulate a round shoelace.

Figure 3:
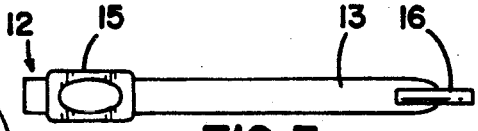
FIG. 3 is a top view of the preferred adjustable securing apparatus of FIGS. 1 and 2.
Figure 4:
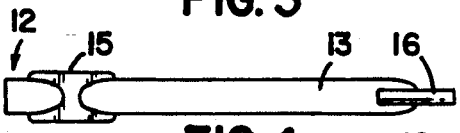
FIG. 4 is a bottom view of the preferred adjustable securing apparatus of FIGS. 1 and 2.
Figure 5:
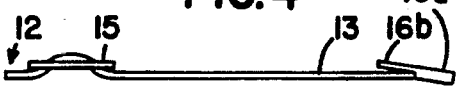
FIG. 5 is a side view of the preferred adjustable securing apparatus of FIGS. 1 and 2.

As is best illustrated in FIGS. 3–5, the preferred adjustable securing apparatus 12 contains a resilient member 13 of unspecified length, with a permanently affixed gripping member 16 on one end and an adjustable gripping member 15 releasably engaged with the resilient member at some point along the length thereof.

The fixed gripping member 16 and the adjustable gripping member 15 may be constructed from a variety of materials, such as plastic, metal or rubber, or some other suitable material. The adjustable gripping member 15 is preferably constructed similar to a belt buckle, where the dimensions of the adjustable gripping member are larger than the eyelet 14. It will be understood that a variety of adjustable gripping members 15 are possible. For example, a simple clip structure may replace the buckle configuration disclosed herein.

Figure 2:
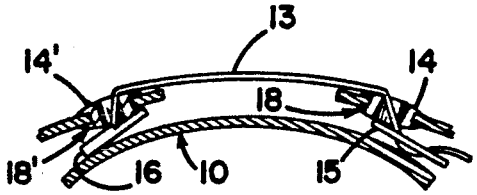
FIG. 2 is a cross-sectional view of FIG. 1.
Figure 9:
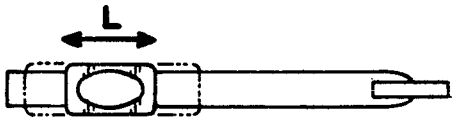
FIG. 9 depicts the preferred method of adjustment of the preferred adjustable gripping member of the present invention.

As is illustrated in FIGS. 2 and 3, the buckle construction permits the resilient member 13 to be threaded onto the adjustable gripping member 15 in a releasably engaged fashion. As is illustrated in FIG. 9, the adjustable securing member 15 remains free to slide left or right on the resilient member 13 along the longitudinal axis "L", thus allowing the effective length of the securing apparatus 12 to be adjusted.

Figure 6:
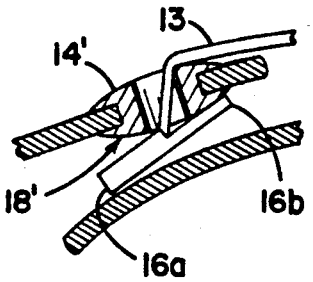
FIG. 6 is a detailed view of the interaction of the preferred stationary gripping member with an eyelet of a shoe.
Figure 7:
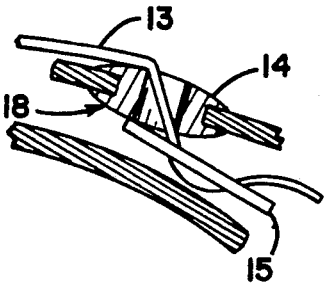
FIG. 7 is a detailed view of the interaction of the preferred gripping member with an eyelet of a shoe.

The preferred fixed gripping mechanism 16 is of a barb-type construction, where the terminal end of the fixed gripping member **16*a* is preferably affixed to the resilient member 13 by crimping, or other means. The free end 16*b* of the fixed gripping member 16 preferably remains unattached. Operation of the barb-type construction of the fixed gripping member 16 is illustrated in FIG. 6. Once the fixed gripping member 16 is slid through an eyelet 14', the terminal end 16*a* and free end 16*b* engage the back surface of the eyelet 18'** on generally opposite sides thereof.

Figure 8:
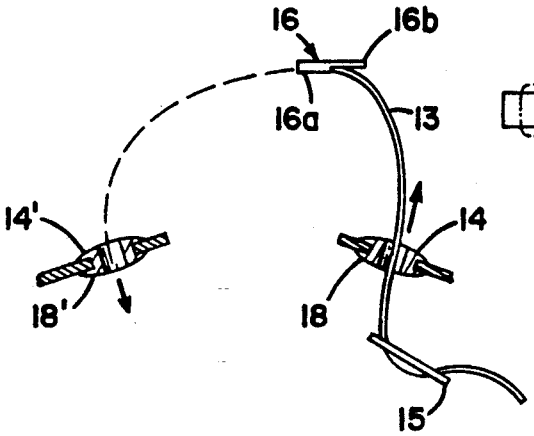
FIG. 8 is a cross-sectional illustrating the preferred method of inserting the adjustable securing apparatus with an eyelet on a shoe.

The preferred method of use is depicted in FIG. 8. The terminal end **16*a* of the adjustable securing apparatus 12 is preferably passed up through an eyelet 14 in the shoe (not shown) until the adjustable gripping member 15 is restrained by the back surface 18 of the eyelet 14. The adjustable gripping member 15 is too large to pass through the eyelet 14, and thus remains secured to the back side 18 thereof. The terminal end 16*a* is then passed downward through a preferably opposing eyelet 14'. The terminal and free ends 16*a*, 16*b* of the fixed gripping member 16 then engage with the back surface 18' of the eyelet 14'**.

The resulting configuration is diagrammed in FIG. 2. The resilient member 13 pulls the two gripping members 15 and 16 toward each other, thereby retaining the gripping members 15, 16 against the back side 18, 18' of the eyelets 14, 14'. The removal procedure is the reverse of the above described steps. When the adjustable securing apparatus 12 is in place, as illustrated in FIG. 1, the gripping members 15 and 16 are entirely concealed beneath the eyelets 14, 14'.

The present invention is not limited to the examples discussed above, but may be changed or modified without departing from the spirit or scope of the invention. For example, by changing the length, width, color and/or type of materials used, the present invention can be modified to accommodate a variety of specific needs or desires.

What is claimed is:

1. An adjustable securing apparatus for extending between a pair of generally opposing eyelets on a shoe, comprising:

a resilient member with a first end, a second end, and a length generally corresponding to the distance between the pair of opposing eyelets;

a fixed gripping member with a cross-section small enough so that it may be inserted through the eyelets attached to the first end of the resilient member, the fixed gripping member having a terminal end which is permanently attached to the first end of the resilient member and a free end; and adjustable gripping means for releasably engaging the resilient member along the length thereof, so that adjusting the position of the adjustable gripping means relative to the fixed gripping member alters the operative length of the adjustable securing apparatus.

2. The apparatus of claim 1 wherein the adjustable gripping means is a buckle.

3. The apparatus of claim 1 wherein the adjustable gripping means is constructed of a plastic material.

4. The apparatus of claim 1 wherein the adjustable gripping means is constructed of metal.

5. A method of using an adjustable securing apparatus for extending between a pair of generally opposing eyelets on a shoe, the eyelets having a top and a bottom portion, comprising the steps of:

providing a resilient member with a first and second end, and a length generally corresponding to the distance between the pair of opposing eyelets, a fixed gripping member with a cross-section small enough so that it may be inserted through the eyelets attached to the first end of the resilient member, the fixed gripping member having a terminal end which is permanently attached to the first end of the resilient member and a free end, and an adjustable gripping means for releasably engaging the resilient member along the length thereof, so that adjusting the position of the adjustable gripping means relative to the fixed gripping member alters the operative length of the adjustable securing apparatus;

moving the position of the adjustable gripping means along the resilient member to the desired location;

inserting the fixed gripping member through the bottom portion of an eyelet so that the adjustable gripping means engages the bottom portion of the eyelet; and inserting the fixed gripping member through the top portion of a generally opposing second eyelet so that the terminal end and free end of the fixed gripping member engage with the bottom portion of the second eyelet.

* * * * *